US008015961B1

(12) United States Patent
Brient

(10) Patent No.: US 8,015,961 B1
(45) Date of Patent: Sep. 13, 2011

(54) LONG TIME PERIOD COMBUSTION CHAMBER SYSTEM WITH ENGINE APPLICATIONS

(75) Inventor: Charles Edward Brient, Athens, OH (US)

(73) Assignee: Charles E Brient, Athens, OH (US)

( * ) Notice: Subject to any disclaimer, the term of this patent is extended or adjusted under 35 U.S.C. 154(b) by 0 days.

(21) Appl. No.: 12/875,176

(22) Filed: Sep. 3, 2010

(51) Int. Cl.
*F01K 23/10* (2006.01)

(52) U.S. Cl. ..... 123/257

(58) Field of Classification Search ..... 123/257, 123/531, 533, 204, 234, 236; 60/39.63, 39.64, 60/604, 616, 618
See application file for complete search history.

(56) References Cited

U.S. PATENT DOCUMENTS

| | | | | |
|---|---|---|---|---|
| 3,577,729 | A * | 5/1971 | Warren | 123/188.9 |
| 4,553,513 | A * | 11/1985 | Miles et al. | 123/204 |
| 5,115,775 | A | 5/1992 | Gruenwald | |
| 5,339,632 | A * | 8/1994 | McCrabb et al. | 60/618 |
| 5,603,305 | A * | 2/1997 | Miyake et al. | 123/568.26 |
| 7,370,643 | B2 * | 5/2008 | Hanawa | 123/531 |

OTHER PUBLICATIONS

Physics Today, Nov. 2008 feature article "Research Needs for Future Internal Combustion Engines" by D K Manley, A McIlroy and C A Taatjes.
Journal of Physics: Conference Series 45 (2006) pp. 59-68.
Edwards, et al., "A Comparative Study of Plasma Ignition Systems", SAE Technical Paper Series, No. 830479, pp. 1-12, 1983.
Ziegler, et al., "Influence of a Breakdown Ignition System on Performance and Emission Characteristics", SAE Technical Paper Series No. 840992, pp. 1-13, 1984.

* cited by examiner

*Primary Examiner* — Hieu T Vo

(57) ABSTRACT

A hot combustion chamber (CC) is designed to completely extend the combustion process over 80% to 90% of the cycle period of an internal combustion engine. The long time period combustion (LTPC) provides a large period of time for control of required fuel/air requests and ignition. The CC is supplied with variable quantities of high pressure air from an energy conserving air compressor (AC) through a combustion chamber supply (CCS) and exhales precisely timed expandable combustion products to a two cycle piston (TCP) or rotary drive. The invention solves past problems associated with ignition timing, inefficient combustion, mechanical efficiency and pollution. This CC design makes possible an engine-system for use in transportation vehicles that provides energy storage in a hybrid configuration.

7 Claims, 8 Drawing Sheets

Operate (va & vb) valves by pressure difference demand, ie va1 opens when (piston drops) volume of cylinder increases and closes on compression of air wereas va2 and vb open when pressure rises passing high density air HDA to CCS or ESC.

Valve va1 may operate in relief mode via a mechanical intercept of closing. This allows AC piston to reciprocate without compression and TCP to remain un-pressurized.

OPERATION MODES

Mode 1 - Acceleration
Valves - a,b normal (pressure demand)
SV1 normal closed
SV2 normal open Mode 2 - Coasting
Valve a1 relief (open)
SV1 normal closed
SV2 normal open Mode 3 - Stopping (deceleration)
Valves - a,b normal (pressure demand)
SV1 open
SV2 closed Mode 4 - Storage Supply ESC to CCS
Valves - a1 relief, a2, b normal (pressure demand)
SV1 open
SV2 open/throttle Combustion Chamber Inlet Check Valve Cross-Section Partial Front View Cross-Section Combustion Chamber Out-Let Check Valve Assembly

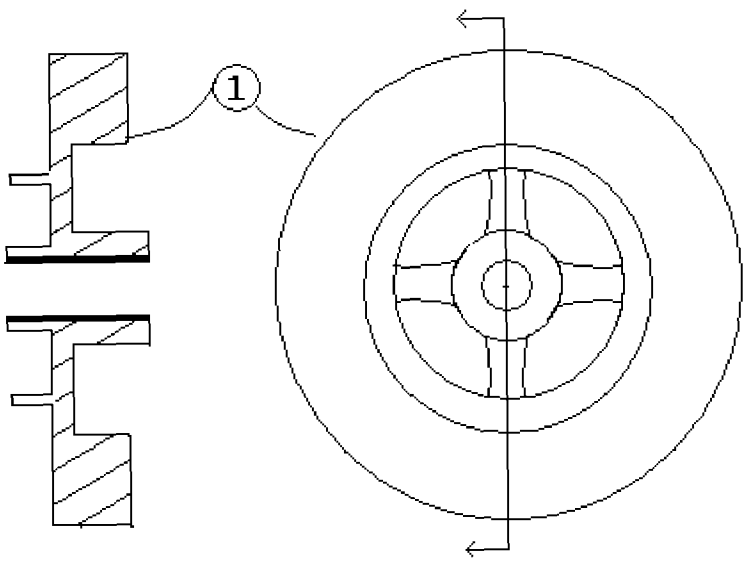
Combustion Chamber
Pressure Compensation Driver
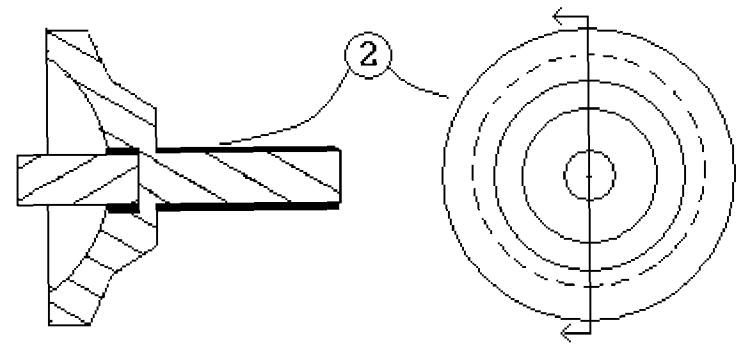
Combustion Chamber
Out-Let Check Valve
Figure 3

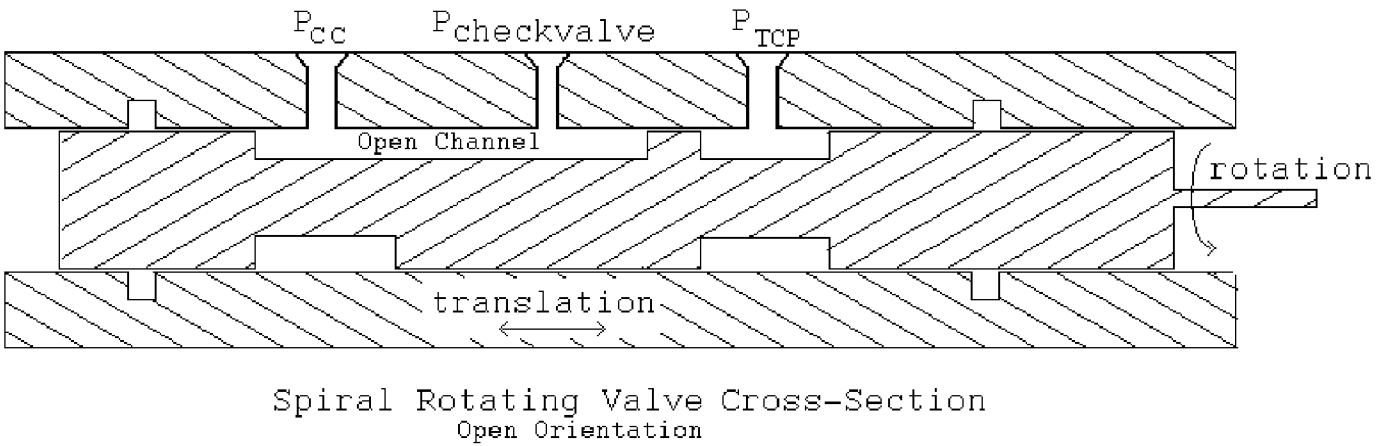
Spiral Rotating Valve Cross-Section
Open Orientation
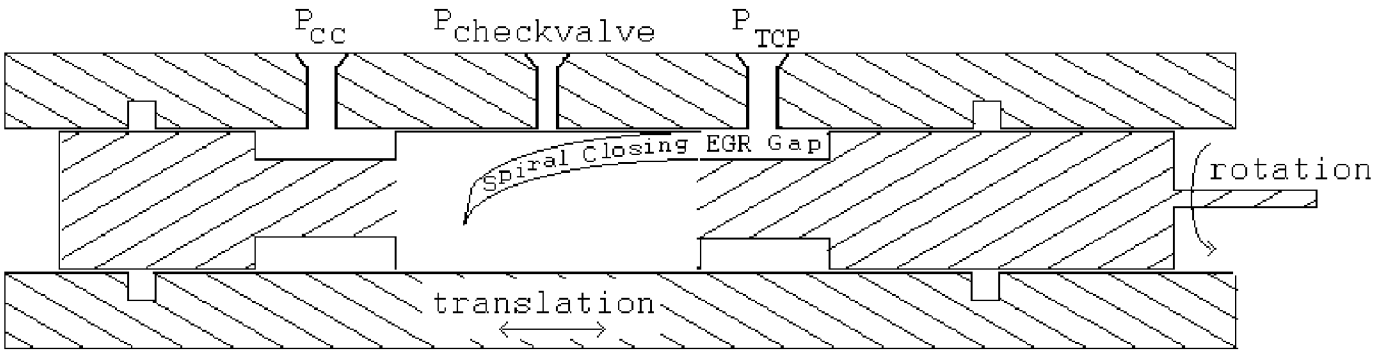
Spiral Rotating Valve Cross-Section
Closing Orientation
Figure 5

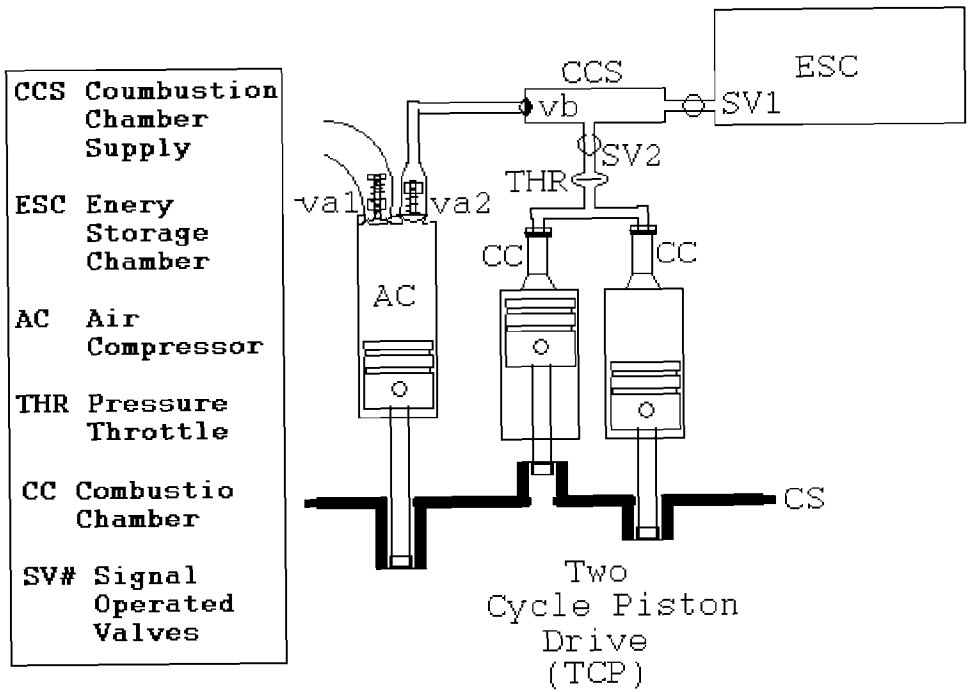

Operate (va & vb) valves by pressure difference demand, ie va1 opens when (piston drops) volume of cylinder increases and closes on compression of air wereas va2 and vb open when pressure rises passing high density air HDA to CCS or ESC.

Valve va1 may operate in relief mode via a mechanical intercept of closing. This allows AC piston to reciprocate without compression and TCP to remain un-pressurized.

OPERATION MODES

Mode 1 - Acceleration
Valves - a,b normal (pressure demand)
SV1 normal closed
SV2 normal open Mode 2 - Coasting
Valve a1 relief (open)
SV1 normal closed
SV2 normal open Mode 3 - Stopping (deceleration)
Valves - a,b normal (pressure demand)
SV1 open
SV2 closed Mode 4 - Storage Supply ESC to CCS
Valves - a1 relief, a2, b normal (pressure demand)
SV1 open
SV2 open/throttle

Figure 7

LONG TIME PERIOD COMBUSTION CHAMBER SYSTEM WITH ENGINE APPLICATIONS

TECHNICAL FIELD

The standard four-cycle spark ignition (SI) engine operates with an air/fuel ratio close to the stoichiometric requirement. This provides several limits on the ability to prevent detrimental explosive knocking and the high compression ratios required for high efficiency. Diesel compression ignition (CI) engines have higher efficiency, but with the environmental pollution problems of released unburned hydrocarbons and $NO_x$. These technologies provide short time period combustion and lower intrinsic efficiency than is available from the chemical breakdown of their respective fuels. The need to solve these problems has led to studies of homogeneous charge combustion ignition (HCCI).

There are engines which separate the combustion processes and combustion product work expansion. An attempted improvement which provides long time period combustion appears in U.S. Pat. No. 5,115,775 "Internal combustion engine with multiple combustion chambers". In that patent two combustion chambers are used alternately with a piston drive system. This duel combustion chamber system is limited in the ability to tailor the combustion parameters and to extract all of the energy from the combustion products.

The present invention provides long time-period combustion advantages due to the use of variable quantities of high pressure stored input air. This invention includes an air compressor with on-demand valves which recycles un-used compressed air and also provides a hybrid use of stored energy. The invention eliminates most sources of energy loss except for the common friction. The combustion chamber in this invention is useful in any internal combustion engine and the associated system components are unique in conserving all forms of energy associated with its use.

BACKGROUND OF THE INVENTION

The combustion process has received broad areas of research commitment. In the Physics Today, November 2008 feature article "Research Needs for Future Internal Combustion Engines" by D K Manley, A Mcllroy and C A Taatjes, a large array of theoretical and experimental efforts detail the problems and partial solutions. The primary focus of the research detailed, is on providing homogeneous charge combustion ignition (HCCI).

In some engines the idea of fuel stratification is used to allow high compression ratios for lean burn piston engines. Introducing lean low octane number (ON) fuel to begin the burn and the high octane number (ON) fuel to resist the knocking allowed high compression ratios, low temperature in the burn and low production of NOx and CO2. This procedure reported indicates that the coefficient of variation (COV) in "indicated mean effective pressure" (IMEP) may be minimized by maintaining an air/fuel ratio near 23-27. These procedures are required for the standard piston engine due to the lack of combustion tailoring time period and the immediate expansion requirements.

A considerable interest has evolved in HCCI combustion technology. The chemical kinetics of combustion depends on the control of all of the fuel-air parameters including reaction rates. Therefore the isolation of the combustion chamber and the extension of the combustion time period will determine the final outcomes for the combustion and are uniquely incorporated in this invention.

All approaches to HCCI thus far require significant variations in the mechanical systems in order to provide precise timing of events within the combustion cycle, including the use of pre-combustion chambers and variable valve and ignition timing. Although each such scheme has provided HCCI conditions in some operating regions, the lean low power and extreme load regions have imperfections leading to poor efficiency or undesirable combustion product contaminants. The mechanical simplicity in this isolated combustion chamber requires none of these complicated and inadequate mechanical systems.

SUMMARY OF THE INVENTION

Combustion Process:

Hot combustion chambers (CC) receive measured compressed air as a free expansion from the combustion chamber supply (CCS) to ignite a variable content of fuel. No work is done during the free expansion leaving the internal energy of the air to be used in the combustion process. The injected air is heated and the fuel decomposed during a time period which is a large fraction (80%-90%) of the single cycle period under conditions which maximize complete decomposition and energy release. This provides a significant advantage in producing fuel air homogeneity throughout the pre-combustion mixture, a requirement for HCCI combustion. Timing of the output and the output period of combustion products for expansion into two cycle piston (TCP) or rotary drives is precisely controlled by the operation of the CC output check valves. The output period timing allows the retention of a variable quantity of hot exhaust gas products (EGR) for tailoring the following combustion cycle. Because the EGR combustion products include unburned radicals, these will mix with the incoming air/fuel to promote whole volume combustion. The whole volume combustion is further insured by the use of auxiliary plasma discharge. (See FIG. 4) Plasma discharge provides a factor of ten higher electron energy than a standard spark plug and therefore is widely distributed over the combustion chamber (CC) initiating large volume combustion without high temperature flame propagation. (Edwards, et al., "A Comparative Study of Plasma Ignition Systems", SAE Technical Paper Series, No. 830479, pp. 1-12, 1983, Ziegler, et al., "Influence of a Breakdown Ignition System on Performance and Emission Characteristics", SAE Technical Paper Series No. 840992, pp. 1-13, 1984.) The quantity of high density air is gauged such that the maximum combustion product temperature remains below 2000K, minimizing the production of $NO_x$. The combustion temperature may be held constant by choosing a constant fuel/air ratio or allowed to decrease in lean fuel conditions without significant loss of intrinsic efficiency in this invention. Note that no fuel will be trapped in cool crevices in the CC (see FIGS. 1-4) such that all of the fuel will be decomposed.

High Density Air Flow

Input air is introduced into the air compressor (AC) without throttle control loses through energy conserving on-demand valves. If high density air is produced in the air compressor (AC) with a compression ratio between 13 and 20, then a quantity adequate to fill duel combustion chambers CC to pressures between 28 and 35 atmospheres is provided from the combustion chamber supply (CCS). These pressure limits may be altered as necessary for the use of different fuels. In transportation vehicles, alternative storage of air in the energy storage chamber (ESC) (see FIG. 7) is made possible via the AC when long down hill excursions or slowing of the vehicle is requested. In order to control fuel/air ratios a throttle valve adjusts the thermodynamic free expansion flow of high pressure air into the combustion chamber (CC) as required. Stored energy is recycled via release of air from ESC through the CCS without combustion (see FIG. 7). In modes 1 and 4 the AC compressor seamlessly recycles un-needed compressed air automatically back into mechanical energy within the cycle via automatic pressure on-demand valves. When CCS or ESC storage is not required the AC compressor (see FIG. 8) may run in relief mode without compression or disengage completely.

Power Delivery

The power delivered by the combustion process and expansion with an intrinsic thermal efficiency of 65 to 69% is provided, while maintaining the same maximum limits on combustion temperature below 2000 K. This unique low temperature, low pollution combustion is provided due to the maintenance of the fuel/air ratio over the entire operating load conditions. Duel TCP drives can provide 100 hp without increases in pollution products at moderate engine speeds near 2100 rpm. Increased engine speed would allow higher power output without loss of combustion control due to reduced combustion time period (<23 ms). This increased power output is still provided without any increase in combustion temperature and therefore without increased production of undesirable combustion products. Multiple TCP units allow added total power proportional to their number.

Final Summary

The use of this hot isolated combustion chamber insures the use of several of the best available technologies. Hot CC's conserve thermal energy by heating pre-combustion fuel/air mixtures with the thermal energy from previous combustion events. The long combustion period provides combustion tailoring for any fuel. The on-demand input valves provide thermal free-expansions and require no mechanical drive mechanism, eliminating both friction and power consumption. The output of combustion products into the TCP drive can be timed via the TSV for maximum torque and minimum habitation period minimizing the loss of thermal energy via conduction. Output check valves are combustion pressure difference controlled through the TSV valves and opening requires insignificant power cost through combustion pressure difference drives. Simple synchronized TSV valve drives provide both expansion timing and timing period adjustments for the changing combustion load conditions. Atmospheric TCP cylinder pressure by-passes eliminate negative expansion power losses. Open entrance compressors eliminate nearly all common throttle losses experienced in most common engines. On-demand AC compressor valves allow immediate recycling of un-needed compressed air without requiring any exterior control. The independent compressor leads to a hybrid storage of mechanical energy for transportation vehicles without the use of electric drives.

DESCRIPTIONS OF DRAWINGS

FIG. 3 are the diagrams of the components of the output check valve (2) and the pressure compensation driver (1).

FIG. 5 is the cross-section view of the Cylindrical Rotary Timing Signal Valve (TSV).

FIG. 7 is an overlay of the systems and their functional layout which provides labels for the components described in the foregoing claims and their purpose.

DETAILED DESCRIPTIONS

Figure 1:
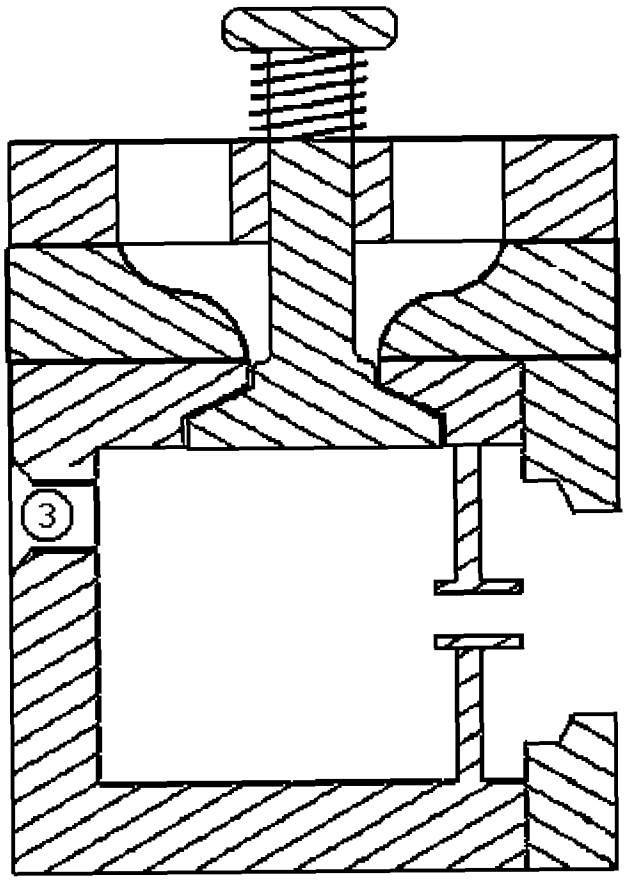
FIG. 1 is a cross-section of the combustion chamber (CC) showing the geometric configuration of the high temperature input check valve location in the combustion chamber which supplies high density combustion air on-demand to the combustion chamber (CC).

FIG. 1 shows the geometric configuration of the high temperature input check valve in the combustion chamber which supplies high density combustion air on-demand to the combustion chamber (CC). The on-demand valve transports the air as required by the pressure drop across the valve without any external mechanical control. The pressure outlet (3) supplies the timing signal valve (TSV) for operation of the output check valve (not shown). The volume of the combustion chamber is comparable to the combustion volume of a standard piston engine near TDC. The pressure in this CC is variable via a throttled energy conserving free expansion, providing an equivalent compression ratio limited only by the pressure available in the combustion chamber supply (CCS). The high temperature of the CC is an important asset of the combustion process and is maintained by a polished reflector housing (not shown) outside of the CC. The reflector isolates and maintains the thermal energy and insulates other components of the engine.

Figure 2:
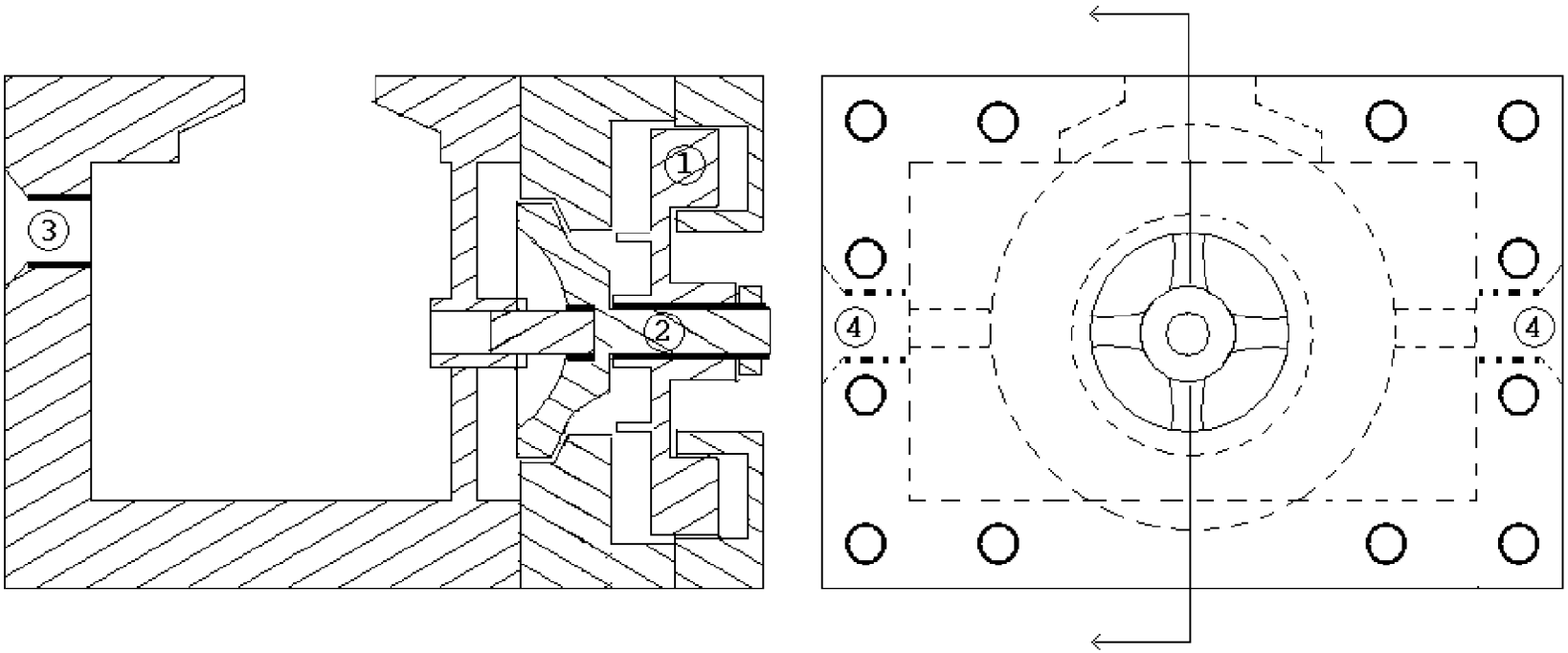
FIG. 2 shows the cross-section of the high temperature output check valve (2) assembly within the CC.

FIG. 2 shows the cross-section of the high temperature output check valve (2) assembly within the CC. The diagram includes the check valve as connected to the combustion chamber pressure compensation driver (1) which opens the valve to allow the output of combustion products into the two cycle piston (TCP) or rotary driver (See FIG. 3 for individual component diagrams). The exit check valve response time is ~1 millisecond. Shown on the left side of the cross section is the pressure compensation driver supply output connection (3) to the timing signal valve (TSV). Shown on the partial front view are the connections for the air supply (4) for the pressure compensation driver from the TSV. Not shown is the TSV (see FIG. 5) which forces the check valve open and subsequently closes the pressure compensation driver by opening the pressure bypass to the TCP or rotary drive.

FIG. 3 are the diagrams of the components of the output check valve (2) and the pressure compensation driver (1) which are coupled during assembly.

Figure 4:
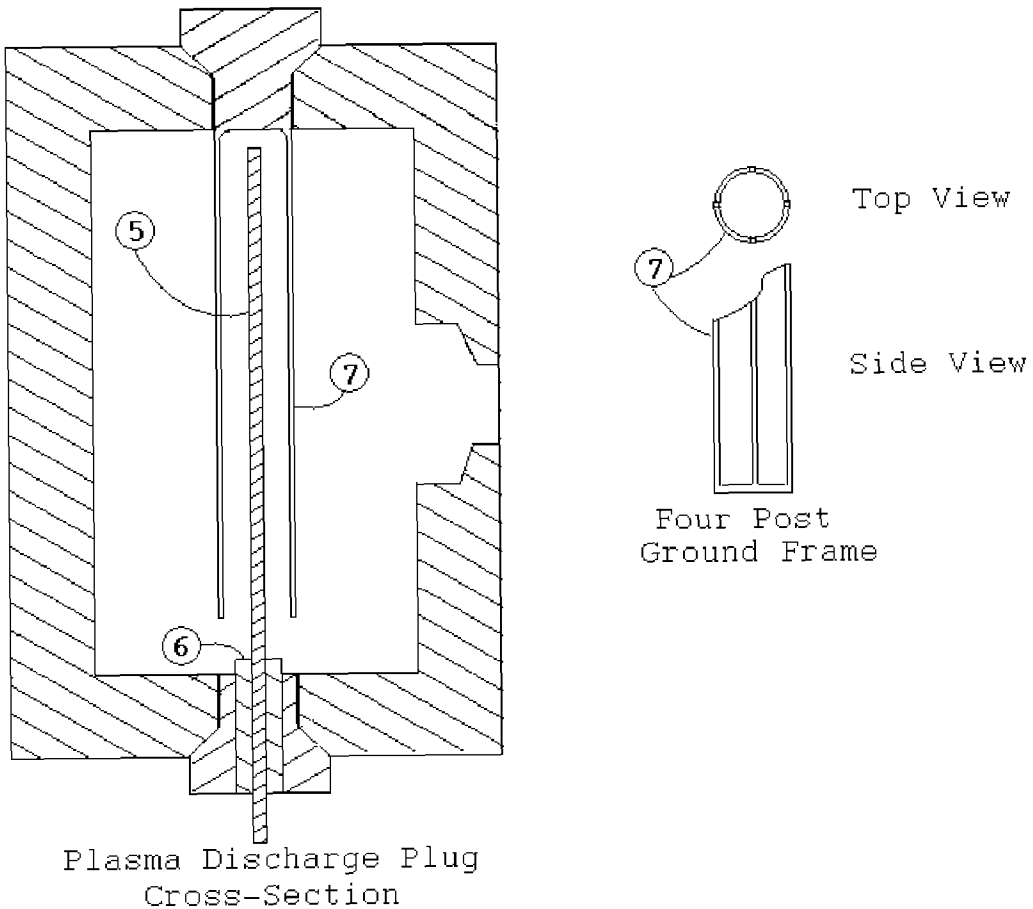
FIG. 4 is the auxiliary plasma discharge plug within the combustion chamber showing the geometry with electrode (5), insulators (6) and ground ribs (7).

FIG. 4 is the auxiliary plasma discharge plug (PDP) within the combustion chamber showing the geometry with electrode (5), insulators (6) and ground ribs (7). The plasma discharge cage is representative of the size which fills the entire length of the chamber and provides auxiliary ignition over the major volume of the homogeneous air/fuel mixture to initiate and insure complete combustion when required (especially during cold start).

Figure 6:
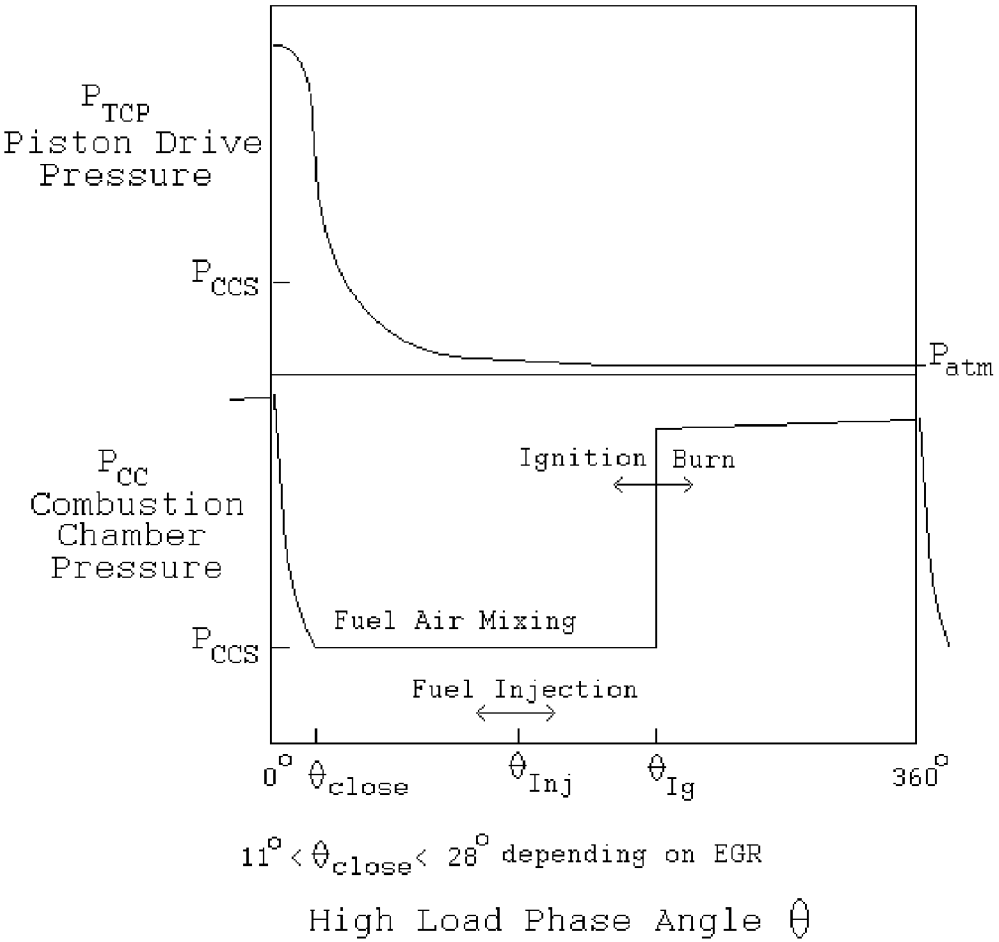
FIG. 6 is a high load comparison of the pressure ($P_{TCP}$) in the two cycle piston drive simultaneous with the combustion chamber Pressure ($P_{CC}$).

FIG. 5 is the cross-section view of the Cylindrical Rotary Timing Signal Valve (TSV) which directs the opening pressure ($P_{CC}$) from the combustion chamber to the check valve driver in-sync with engine cycle and the closing pressure ($P_{TCP}$) delayed by the phase difference required for EGR (see FIG. 6). The translation of the housing varies the spiral closing gap timing and provides the variable delay required by the changing load requests for EGR. The input opening gap may also be spiraled for the change in combustion product output timing if variations in exhale time to the TCP or rotary drive improve efficiency via more rapid work extraction.

FIG. 6 is a high load phase angle comparison of the TCP pressure ($P_{TCP}$) versus engine phase angle and the simultaneous Combustion Chamber Pressure ($P_{CC}$). The same $P_{CC}$ phase curve precedes and follows the $P_{TCP}$ phase curve. The long time period pressure near the CC closing, demonstrates the flexible period for tailoring the high load combustion. The TCP pressure in this high load graph drops to the CCS combustion chamber storage pressure near 11° and the hot combustion products drive the TCP through the complete expansion to atmospheric pressure. If EGR is needed the outlet valve may be closed before 28°.

FIG. 7 is an overlay of the systems and their functional layout which provides labels for the components described in the foregoing claims and their purpose. Four possible modes of operation, 1-Acceleration, 2-Coasting, 3-Stopping and 4-Energy Storage are defined by the required valve settings.

Figure 8:
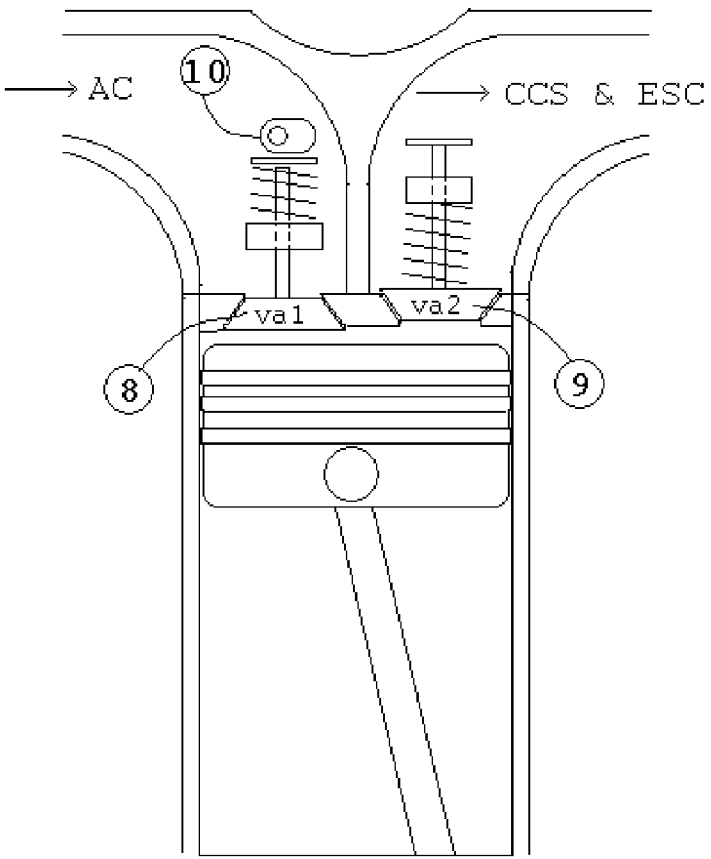
FIG. 8 is a pictorial representation of the air compressor (AC) and the on-demand valve configuration.

FIG. 8 is a pictorial representation of the un-throttled air compressor (AC) and the on-demand valve configuration. High density air is produced in the AC with a compression ratio between 13 and 20 and in a quantity adequate to fill duel combustion chambers (CC) from the CCS supply. The input on-demand valve vat (8) is diagramed with the relief cam (10) shown. This cam is activated electronically based on the need to operate in open mode 2 (coasting) or on-demand in modes 1 (CCS storage) and 4 (ESC energy storage). See FIG. 7 for these details. Valve va2 (9) supplies high pressure air either to CCS or through CCS into ESC chambers as in modes 1 and 4.

The invention claimed is:

1. A hot isolated combustion chamber (CC) supplied with high pressure air from a combustion chamber supply (CCS) filled by an energy conserving air compressor (AC) and fuel injector and with timing signal valve (TSV) control and plasma discharge plug (PDP), is a primary system design with tailored combustion control for 80% to 90% of an engine cycle period with optimization of efficiency and pollution control when used with a two cycle piston (TCP) drive or rotary engine.

2. As in claim 1 a CC with on-demand high pressure input valve.

3. As in claim 1 a CC with pressure driven output valve.

4. As in claim 1 a CC high pressure air combustion chamber supply (CCS) with energy conserving measured free expansion.

5. As in claim 1 an energy conserving air compressor (AC) with on demand input and output valves.

6. As in claim 1 a timing signal valve (TSV) supplying synchronized high pressure air to the CC output valve.

7. As in claim 1 an electronically controlled plasma discharge plug (PDP) filling the CC.

* * * * *